United States Patent [19]

Montrasi et al.

[11] 3,983,627

[45] Oct. 5, 1976

[54] INTERCHANGEABLE BLADE TYPE RAZOR

[76] Inventors: Erminio Montrasi; Antonio Massi, both of 20063 Cernusco Sul Naviglio, Milan, Italy

[22] Filed: Apr. 7, 1975

[21] Appl. No.: 565,560

[30] Foreign Application Priority Data

Apr. 9, 1974 Italy ..... 21067/74

[52] U.S. Cl. ..... 30/53; 30/336

[51] Int. Cl.[2] ..... B26B 21/10

[58] Field of Search ..... 30/30, 31, 53–55, 30/162, 293, 335–339

[56] References Cited

UNITED STATES PATENTS

| | | | |
|---|---|---|---|
| 1,274,139 | 7/1918 | Clark | 30/335 X |
| 2,539,574 | 1/1951 | Fulmer | 30/53 X |
| 2,979,818 | 4/1961 | Bakarich | 30/54 X |
| 3,171,201 | 3/1965 | Carifi | 30/335 |
| 3,754,325 | 8/1973 | Tornvall | 30/30 |

*Primary Examiner*—Al Lawrence Smith
*Assistant Examiner*—Gary L. Smith

[57] ABSTRACT

A razor is disclosed characterized by ready interchangeability and safe stability of the blade, a proper protection of the blade during shaving and at inoperative periods, as well as a more "anatomic" handle. A longitudinally extending sheath is connected to a blade handle. The sheath is formed of a single piece of resilient material forming a pair of longitudinally extending wall portions, and a blade holder is disposed between the wall portions of the sheath. A first longitudinally extending section of the sheath is formed with wall portions which converge toward their distal longitudinal edges. A first longitudinally extending section of the blade holder includes a pair of wall portions which clampingly engage a razor blade disposed therebetween and the first longitudinally extending section of the blade holder is clampingly engaged by the wall portions of the first longitudinally extending section of the sheath with the cutting edge of the blade protruding outwardly of the distal edges of the wall portions of the sheath. A second longitudinally extending section of the sheath includes portions which form a slot therebetween. A second longitudinally extending section of the blade holder includes distal end portions which are joined by a clevis and the clevis is disposed to protrude outwardly of the slot formed in the second longitudinally extending section of the sheath. The clevis includes an actuating surface designed to receive manual force for moving the first longitudinally extending section of the blade holder outwardly of the sheath for replacing a blade supported by the blade holder.

4 Claims, 12 Drawing Figures

INTERCHANGEABLE BLADE TYPE RAZOR

This invention relates to a face shaving device for advantageously replacing ordinary razors. Commercial availability of many so-called "safety" razors having a stationary or interchangeable blade is well known, such razors substantially comprising a handle and a sharp or cutting blade with particular arrangement and association with further elements in order to facilitate as far as possible both "shaving operation" and blade protection at inoperative periods and particularly during use thereof. Such razors suffer from considerable shortcomings which according to type or characteristics may be: insufficient blade protection, difficulty in blade replacement, structural complexity and so on.

It is the main object of the present invention to provide a razor free of the above mentioned shortcomings, capable of assuring a ready interchangeability and safe stability of the blade, a proper protection of the blade during shaving and at inoperative periods, as well as a more "anatomic" handle.

A razor according to the invention will now be described with reference to a preferred embodiment as shown in the accompanying drawings, in which.

Figures 1, 2, 3, 4, 5, 6, 7, 8, 9, 10, 11, 12:
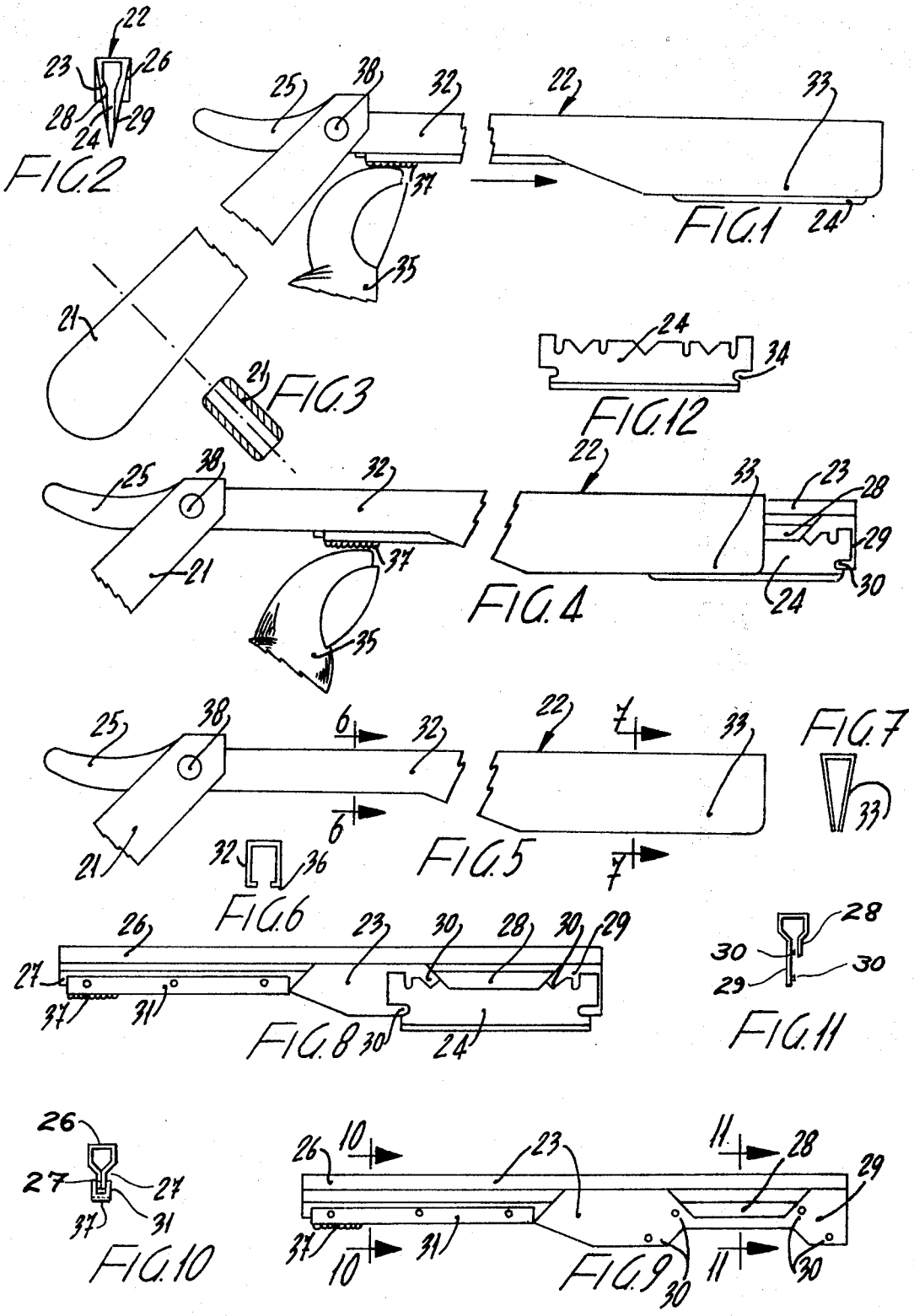
FIG. 1 is a side view showing the razor at work attitude, that is "open" with blade inserted.
FIG. 2 is a cross-section along line 2—2 of FIG. 1.
FIG. 3 is a sectional view of the handle.
FIG. 4 is a view showing the razor with the blade holder partially longitudinally "displaced" in the direction of arrow F.
FIG. 5 is a view showing the razor without the blade holder.

FIGS. 6 and 7 are cross-sections along lines 6—6 and 7—7, respectively, of FIG. 5;

FIG. 8 is a view showing the blade holder with a blade;

FIG. 9 is a side view of the blade holder only;

FIGS. 10 and 11 are cross-sections along lines 10—10 and 11—11, respectively, of FIG. 9; and FIG. 12 is a front view of the blade.

A razor according to the invention substantially comprises a handle 21, a sleeve or sheath 22, a blade holder 23, a blade 24, a sleeve or sheath tail 25, a blade holder body or housing 26, small fins 27, a small blade holder side 28 and a large blade holder side 29, blade pawls 30, a notched clevis 31, a sleeve or sheath housing 32, sleeve or sheath flanges 33, side blade recesses 34, the drawings also showing the user's fingers 35 acting on blade holder 23.

Blade 24 (in the example blade 24 represents a half blade of Gillette type) is inserted between the two sides 28 and 29 of blade holder 23, so that the side recesses or notches 34 of blade 24 coincide with pawls 30. The preset resiliency of sides 28 and 29 allows insertion of blade 24 and builds up a sufficient pressure of the sides against each other to stabilize the blade with projected cutting edge. Through fastening rivets, welding and the like, the rear portion of blade holder 26 is reinforced by application of a clevis 31 having indentations or knurls 37 to provide an actuating surface with sufficient grip on the user's finger 35. As shown in the drawings, blade holder body 26 comprises a channel member opening in a downward sense, the arms of which substantially terminates at the back side in parallel fins 27 bearing on each other. At the "work" side, that is where blade 24 will be attached, the arms of blade holder body 26 terminate in two fins, a large fin 29 acting as a support for blade 24 and a smaller fin 28 for stabilizing the blade.

Razor sleeve or sheath 22 comprises a hollow body or housing also of somewhat channel shape. Centrally, the channel arms 32 terminate at right angle at 36 and face inwardly to provide a proper bearing socket for the back side of blade holder 23. At the end portion designed to accomodate blades 24, the channel sides are made flat and parallel as large closed wings 33 (FIG. 7). At the opposite end, sleeve or sheath 22 carries a tail-shaped member 25 for a most anatomic grip of a user's fingers.

As above stated, the central portion is mainly designed to accomodate and guide the back side and rear portion of blade holder 23, whereas the large wings 33 accomodate and press blade holder 23 at the "blade zone." By such a configuration, the sleeve or sheath wings resiliently press blade 24 against the blade holder, thus adding to the stability of the blade and blade holder assembly. As apparent from the drawings and description, any Gillette type of blade, either half of ordinary double-cut blades, or a single-cut blade, can be applied to the razor.

The half double-cut blades are positioned by the above described pawls 30, whereas single-cut blades, generally provided with small holes, are positioned by pawls which are located at the position corresponding to that of said small holes.

Attachment of blade 24 is completed by the pressure of the two small and large sides 28, 29, respectively, of blade holder 23. The latter, as completed with a blade 24, is inserted in the razor sleeve or sheath 22.

The structure of sleeve or sheath 22, substantially in the form of a large axially open clevis, operates to guide and stabilize the blade holder body or housing 26, as well as to apply a further pressure of sides 28 and 29 of the blade holder on blade 24, thus rendering the razor sleeve or sheath and blade holder a single unit.

The notched back of body or housing 26 of the blade holder and the cutting edge of blade 24 project downwardly from the longitudinal aperture of sleeve or sheath 22.

Therefore, not only is a protection provided against blade deterioration, but also a restriction to the projection of the cutting edge, thus obtaining a proper operating safety and accordingly also a "safety" razor.

When desiring to change a blade 24, it will suffice to axially push blade holder 23 in the direction of arrow F1, acting by finger 35 on notched back 37 of blade holder 23 projecting from sleeve or sheath 22, such as shown in FIGS. 1 and 4.

Also, by means of the present invention a blade can be replaced without complete removal of the blade holder.

From the foregoing, the features and advantages of the invention are apparent, and particularly the possibility of using any commercial type of blade, easiness in replacing the blade, "double" stabilization of the blade as provided both by the pressure of the blade holder sides and large flanges or wings of the sleeve or sheath.

It is particularly advantageous that the movement of blade holder 23 relative to sleeve or sheath 22 occurs along its longitudinal axis, and accordingly in a direction approximately transverse of the shaving direction, so that during shaving the risk is avoided of any tendency to exit of the blade holder and separation of the blade.

The subject invention has been described and shown only by way of unrestricting example and for the only purpose of showing its essential features. It is apparent that the structure of the razor according to the invention can have many changes and modifications and even further improvements made thereto according to economical conditions and specific expedience and requirements of industrial production, commercial marketings and use and the like, and include in the case other systems or means, without departing for this from the scope of the present invention.

We claim:

1. Apparatus for supporting a razor blade comprising a handle, a longitudinally extending sheath connected to the handle; said sheath being formed of a single piece of resilient material having means defining a pair of longitudinally extending wall portions having first longitudinal edges joined to each other; a first longitudinally extending section of the sheath being formed with the wall portions converging toward their distal longitudinal edges; a second longitudinally extending section of the sheath being formed with the wall portions having distal end portions which are co-planar and which have distal edges which are spaced from each other and form a slot therebetween; a blade holder including a single piece of resilient material having means defining a pair of longitudinally extending wall portions having first longitudinally extending edge portions joined to each other; a first longitudinally extending section of the blade holder being formed with the surface of one wall portion being greater than the surface of the other wall portion; a plurality of pins protruding from the surface of said one wall portion for engaging appropriate slots or notches in a razor blade and said other wall portion being biased toward said first wall portion for clampingly engaging a razor blade disposed therebetween; a second longitudinally extending section of said blade holder having distal end portions which are joined by a clevis; an actuating surface fixedly connected to a first portion of the clevis; said blade holder being disposed between the wall portions of said sheath with said first portion of the clevis protruding outwardly from the slot formed in the second longitudinally extending section of the sheath and with the first longitudinally extending section of the blade holder clampingly engaged by the wall portions of the first longitudinally extending section of the sheath in such a manner that the cutting edge of a blade supported by the blade holder protrudes outwardly of the distal edges of the wall portions of the first longitudinally extending section of the sheath; said blade holder being movable longitudinally relative to said sheath by application of manual force to said actuating surface for moving the first longitudinally extending section of the blade holder outwardly of the sheath for replacing a blade supported by the blade holder.

2. Apparatus as set forth in claim 1, wherein said single piece of resilient material forming said pair of longitudinally extending wall portions of said blade holder comprises a single piece of sheet metal, and wherein said single piece of resilient material forming said sheath comprises a single piece of sheet metal.

3. Apparatus as set forth in claim 1, wherein said single piece of resilient material forming said sheath comprises stainless steel, wherein said single piece of resilient material forming the wall portions of said blade holder comprises a metallic material, and wherein said handle is formed of a plastic material.

4. Apparatus as set forth in claim 1, including a tail portion including a finger engaging surface, said handle, said tail portion and said sheath each including a hole formed in a respective portion thereof, and a pin member passing through the holes in the said tail member said handle and said sheath.

* * * * *